US005546617A

United States Patent [19]

Sandrin

[11] Patent Number: 5,546,617

[45] Date of Patent: Aug. 20, 1996

[54] WATER FIXTURE FOR BATHTUBS OR SIMILAR VESSELS AND METHOD OF INSTALLING THE SAME

[75] Inventor: Gianni Sandrin, Pordenone, Italy

[73] Assignee: Albatros System S.p.A., Pordenone, Italy

[21] Appl. No.: 302,195

[22] Filed: Aug. 31, 1994

[30] Foreign Application Priority Data

Sep. 24, 1993 [IT] Italy ..... PN930025 U

[51] Int. Cl.[6] ..... E03C 1/08

[52] U.S. Cl. ..... 4/541.6; 4/541.1; 285/197

[58] Field of Search ..... 4/541.1, 541.3, 4/541.4, 541.6; 277/152, 71, 1, 29; 239/600; 285/194, 197

[56] References Cited

U.S. PATENT DOCUMENTS

| | | | |
|---|---|---|---|
| 3,258,271 | 6/1966 | Hollingsworth | 277/1 |
| 4,123,068 | 10/1978 | Van Gorder | 277/29 |
| 4,861,044 | 8/1989 | Jay | 277/152 |
| 4,982,459 | 1/1991 | Henkin et al. | 4/541.4 |
| 5,173,973 | 12/1992 | Mersmann | 4/541.1 |

FOREIGN PATENT DOCUMENTS

| | | | |
|---|---|---|---|
| 234723 | 9/1987 | European Pat. Off. | 4/541.6 |

*Primary Examiner*—Henry J. Recla
*Assistant Examiner*—Charles R. Eloshway
*Attorney, Agent, or Firm*—Wenderoth, Lind & Ponack

[57] ABSTRACT

A fixture includes a hollow body adapted to be secured in an opening of a tub by a ring nut which is screwed to the body in such a manner that the wall of the tub is clamped between the hollow body and the ring nut. A ring is mounted on the body so as to cover an outer edge of the body defining the periphery of the end surface. The ring has a front wall that covers the end surface of the body and is to be situated between the end surface and the wall of the tub. The hollow body is also provided with a vent through-hole and a second through-hole extending from a recess in the end surface of the body. Sealant can be injected through the second through-hole into the spaces delimited by the boy, the ring and the wall of the tub.

7 Claims, 1 Drawing Sheet

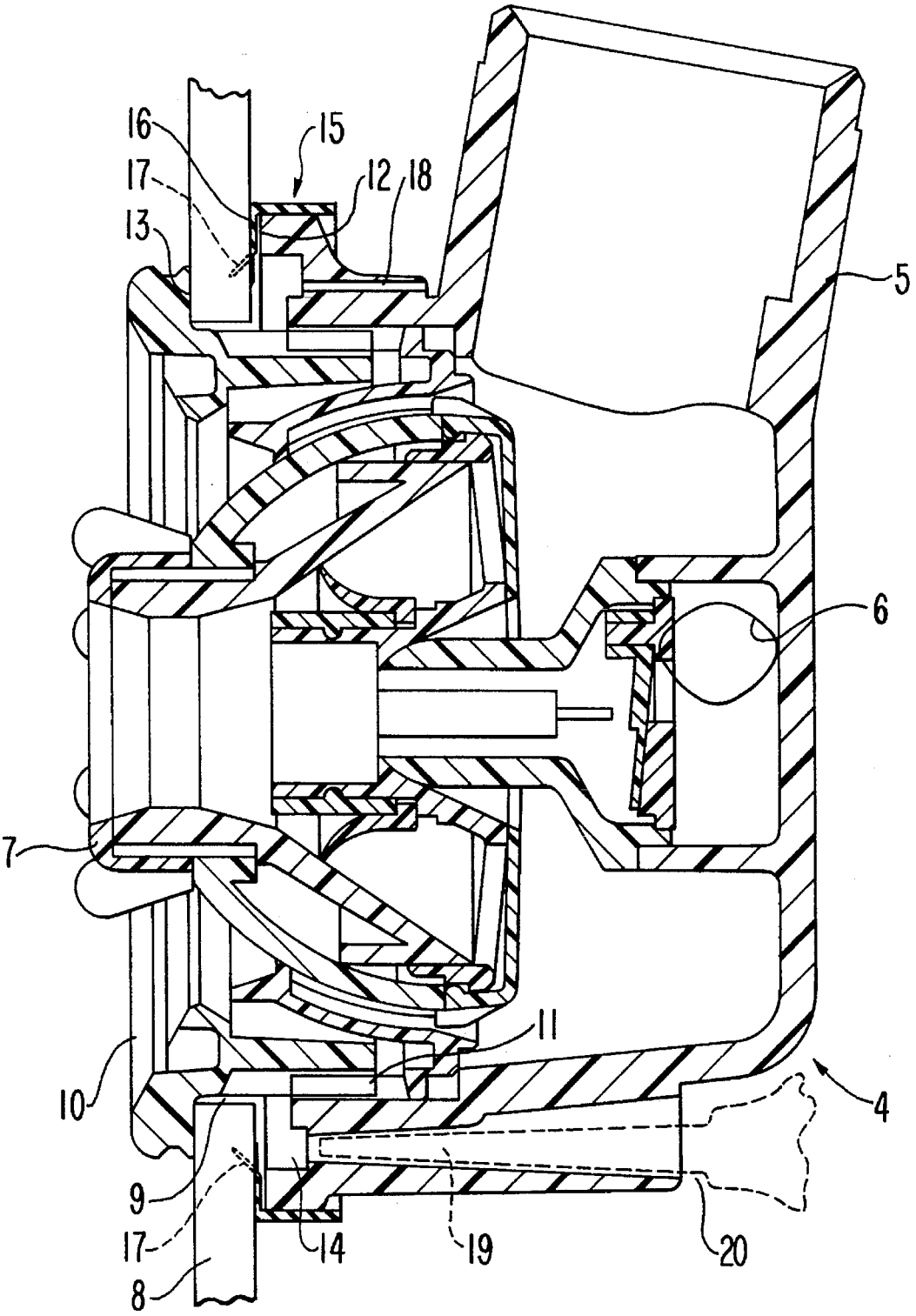
16
15
17
12
18
13
5
6
7
11
10
4
9
17
14
19
20
8

WATER FIXTURE FOR BATHTUBS OR SIMILAR VESSELS AND METHOD OF INSTALLING THE SAME

BACKGROUND OF THE INVENTION

1. Field of the Invention

This invention relates to an improved type of water fixture for bathtubs or similar hygienic vessel. In particular, but not exclusively, the present invention relates to an improved type of water outlet adapted to be used in whirlpool-type bathtubs or pools for delivering a mixture of air and water under pressure.

2. Description of the Related Art

A known water delivery outlet, such as that disclosed in EP-A-0 560 097, comprises a hollow body (manifold) provided with a water inlet, an air suction inlet, and a swiveling outlet nozzle through which an air-water mixture is discharged into the bathtub. The water delivery outlet is mounted on the wall of the whirlpool-type bathtub, in a suitable hole, with a sealing member interposed therebetween. More specifically, a front ring nut is screwed to the front inner surface of the manifold to mount the delivery outlet to the tub or pool wall. In order to ensure an effective water-tight seal at the hole in the tub wall, so as to prevent water leakages or seepages that could bring about flooding and/or create corrosion problems, it is a current practice to apply a layer of silicone-based sealant on the surfaces of the manifold and the ring nut between which the tub wall is interposed and then to tighten the manifold and ring nut to one another.

When the ring nut is screwed onto the manifold, the silicone tends to get squeezed away, thereby giving rise to unattractive blurs or smears on the walls of the tub (particularly on those walls exposed to the sight) which can act as dirt traps. Therefore, these smears must be accurately removed through an additional undesired operation which is particularly difficult and labor-intensive, and which could also quite easily cause the surfaces of the tub to be accidentally scratched.

The above-described assembly, with the related drawbacks, is generally employed as a fixture such as an outlet or drain connection, a fixed water-inlet or water-delivery nozzle, etc.

SUMMARY OF THE INVENTION

It is therefore an object of the invention to provide a fixture for bathtubs or similar hygienic vessels, which has such a simple structure that it can be installed in the tub in a particularly convenient, reliable and quick manner.

To achieve this object, the fixture of the present invention includes a hollow body having a screw thread, an end surface positioning the hollow body against one side of the wall of the vessel into or from which fluid is to be introduced or drained from the fixture, a recess defined in a portion of the end surface so as to define a space between the hollow body of the fixture and the wall of the vessel, a first vent through-hole having one end open to the recess and another end open at a peripheral surface of the hollow body, and a second through-hole having one end open at an outer peripheral surface of the hollow body and another end open to the recess. A front ring nut has a screw thread threaded to the screw thread of the hollow body, and an end surface positioned against the other side of the wall of the vessel. That is, the front ring and the hollow body clamp the wall therebetween such that the fixture is secured in place in the hole in the wall of the vessel. A ring extends over an outer edge of the body defining the outer periphery of the end surface of the body. Part of the ring, namely a front wall, is positioned between at least part of the end surface of the hollow body and the one side of the wall of the vessel.

Sealant forming a seal between the wall and the hollow body is located in a space defined by the recess of the hollow body. The sealant is introduced into such space through the second through-hole in the hollow body. The introduction of the sealant into this space is facilitated by the first vent through-hole through which air vents at the time the sealant is injected through the second through-hole.

The fixture may be installed easily in the hole in the wall of the vessel, i.e. merely by screwing the ring nut into the hollow body with the front wall of the ring interposed between the end surface of the hollow body and one side of the wall. Moreover, the ring prevents the sealant from overflowing to a significant degree beyond the periphery of the end surface of the hollow body.

BRIEF DESCRIPTION OF THE DRAWINGS

These and other features and advantages of the present invention will be more readily and clearly understood on the basis of the description which is given below by way of a non-limiting example with reference to the accompanying drawing, in which the FIGURE is a schematic longitudinal sectional view of an embodiment of the fixture according to the present invention.

DETAILED DESCRIPTION OF THE PREFERRED EMBODIMENT

With reference to the FIGURE, the fixture constitutes, for instance, a delivery outlet of a whirlpool-type bathtub or pool, whose general structure and operation are substantially similar to the ones described in the aforementioned EP-A-0 560 097.

The fixture mainly comprises a hollow body (manifold) 4 provided with at least one inlet 5, through which it is capable of receiving water under pressure, as well as at least one suction opening 6 through which air can be drawn into the manifold 4. The fixture is additionally provided at the front thereof with a swiveling outlet nozzle 7 which preferably has an adjustable through-flow section and is capable of delivering a mixture of air and water under pressure.

Such a fixture is adapted to be mounted on the wall 8 of a whirlpool-type bathtub, or any other similar piece of sanitary equipment, in an appropriate opening 9 provided in the wall 8. The installation of the fixture is carried out by a front ring nut 10 of the fixture which is threaded to the front inner surface of the manifold 4, such inner surface quite obviously being provided with an appropriate screw thread 11.

In particular, the opposite sides of the wall defining the periphery of the opening 9 are sandwiched between respective end surfaces 12 and 13 of the manifold 4 and the ring nut 10, respectively. Furthermore, a recess including an annular groove 14 is formed in the manifold 4 adjacent surface 12. This groove 14 can serve as the seat for a gasket or similar sealing means (not shown).

According to the invention, however, such a sealing means is not necessary. Rather, an elastic ring 15 is mounted on the manifold 4 over an outer edge defining the periphery of end surface 12. The ring 15 has a substantially L-shaped cross section, and includes a front wall 16 that extends radially over at least part of the end surface 12 of the manifold 4. Consequently, when the water delivery outlet fixture is mounted to the wall 8, the end surface 12 is positioned, via the wall 16 of the ring 15, against the respective surface of the side wall 8 defining the periphery of the opening 9. An annular lip 17 serves as a sealing gasket. The lip 17 is shown in the FIGURE both in a normal relaxed position (by dashed lines) in which the lip 17 is inclined from a free end of the wall 16, and in an as-mounted position (by solid lines) between at least part of the end surface 12 and the wall 8.

The manifold 4 also has several through-holes including at least one vent through-hole 18 and a second through-hole 19. Both of the through-holes have ends open at the recess in the end surface 12 of the manifold 4, preferably open to the bottom of the annular groove 14. In a preferred manner, the holes 18 and 19 are provided at locations in the manifold diametrically opposite one another.

The second through-hole 19 has a diameter which is greater than that of the vent through-hole 18. Preferably, the through-hole 19 tapers from the rear portion of the water fixture, i.e. from an end thereof open to the periphery of the manifold 4, so as to define a seat adapted to accommodate the outlet spout 20 (shown in phantom) of a device for injecting silicone or similar liquid or semi-liquid sealant.

The installation of the fixture according to the present invention is carried out in a manner as can be inferred from the description above, i.e. by positioning the end surface 12 of the manifold 4 opposite one side of the wall, screwing the ring nut 10 to the manifold 4 with part of the ring 15 interposed between the wall 8 and the surface 12 to secure the water fixture in place on the wall 8, and injecting a controlled amount of silicone sealant using a suitable application device into the through-hole 19 from the outside of the manifold 4. The silicone sealant spreads along the groove 14 and into any gap between the ring 15 and the surface 12 of the manifold 4, as well as into all of the spaces that possibly communicate with groove 14 and exist between the ring nut 10, the manifold 4, the ring 15 and the wall 8. Such a distribution of the silicone sealant is facilitated by the vent hole 18 which enables a volume of air corresponding to the amount of silicone being injected through the through-hole 19 to freely escape.

Therefore, a perfect water-tight seal is achieved with a single, simple operation while an undesired outspread of sealant is prevented.

It will be appreciated that the above-described fixture may be modified in any of a number of ways without departing from the scope of the present invention.

For instance, as has already been pointed out, although the fixture has been described as a water delivery outlet, it may be embodied as other types of fixtures such as a drain manifold, a fixed water inlet injector and the like associated with a bathtub or other vessel, as long as such fixtures comprise a hollow body and a ring nut that can be screwed together for securement in an opening of a bathtub or the like.

What is claimed is:

1. A fixture for use in conveying fluid through a hole in a wall of a vessel, said fixture comprising:

a hollow body having a screw thread, an end surface used to position the hollow body against one side of the wall of the vessel, a recess defined in a portion of said end surface so as to define a space when the hollow body is positioned against the wall of the vessel, a first vent through-hole having one end open to said recess and another end open at a peripheral surface of the body, and a second through-hole having one end open at an outer peripheral surface of the hollow body and another end open to said recess;

a front ring nut having a screw thread threadable to the screw thread of said hollow body, and an end surface used to position the ring nut against the other side of the wall of the vessel, whereby screwing the front ring to said body is used to clamp the wall between said front ring and said hollow body to secure the fixture in place in the hole in the wall of the vessel; and a ring extending over an outer edge of the body defining the outer periphery of said end surface of the body, said ring having a front wall that is positionable between at least part of said end surface of the hollow body and the one side of the wall of the vessel as the fixture is secured in place, whereby when the fixture is secured in place in the hole in the wall of the vessel, the recess defines a space into which sealant can be introduced via the second through-hole, air in the space being vented through the first vent through-hole.

2. A fixture as claimed in claim 1, wherein said through-holes are located at locations in said hollow body diametrically opposite one another.

3. A fixture as claimed in claim 2, wherein said second through-hole tapers from said outer peripheral surface of the hollow body towards said recess to define a seat in which a spout of a device for injecting the sealant can be fitted.

4. A fixture as claimed in claim 1, wherein the front wall of said ring extends radially inwardly from said outer edge of the hollow body over said at least a part of said end surface of the hollow body, and said ring includes an annular lip normally extending at an inclination from a free end of said front wall, said annular lip being self-biased into contact with the one side of the wall of the vessel when the fixture is secured in position to thereby serve as a gasket.

5. A fixture as claimed in claim 1, wherein the recess in the end surface of said hollow body includes an annular groove, said one end of the first vent through-hole and said another end of the second through-hole being open at a bottom of said annular groove.

6. A fixture as claimed in claim 1, and further comprising an outlet nozzle mounted in said hollow body.

7. A method of installing a fixture in a hole in the wall of a vessel, wherein the fixture includes a hollow body having a screw thread, an end surface, a recess defined in a portion of the end surface, a first vent through-hole having one end open to said recess and another end open at a peripheral surface of the body, and a second through-hole having one end open at an outer peripheral surface of the hollow body and another end open to said recess, a front ring nut having an end surface and a screw thread, a ring extending over an outer edge of the hollow body defining the outer periphery of the end surface of the body, said method comprising:

positioning the end surface of the hollow body opposite one side of the wall with a part of said ring interposed between the end surface and the wall;

screwing the ring nut from the other side of the wall to said hollow body via the respective screw threads thereof until the end surface of the ring nut abuts the other side of the wall, and thereby clamping the wall between the end surfaces of the front ring and the hollow body to secure the fixture in position; and once the fixture is secured in position, injecting sealant through said second through-hole into a space, defined by the recess, at the one side of the wall, air in said space being vented through said first vent through-hole during the injection of the sealant.

* * * * *